United States Patent [19]

Lipp et al.

[11] Patent Number: 4,848,919

[45] Date of Patent: Jul. 18, 1989

[54] PINNED MILL FOR MIXERS

[75] Inventors: Eberhard Lipp, Altrip; Hans Wetzel, Mannheim, both of Fed. Rep. of Germany

[73] Assignee: Draiswerke GmbH, Mannheim, Fed. Rep. of Germany

[21] Appl. No.: 857,409

[22] Filed: Apr. 25, 1986

[30] Foreign Application Priority Data

Apr. 27, 1985 [DE] Fed. Rep. of Germany ..... 3515318

[51] Int. Cl.[4] ..... B01F 7/02; B02C 17/20

[52] U.S. Cl. ..... 366/295; 366/307; 366/325; 241/86; 241/98; 241/199.12

[58] Field of Search ..... 366/302, 305, 307, 292, 366/295, 325, 330; 241/86, 95, 98, 199.12

[56] References Cited

U.S. PATENT DOCUMENTS

| | | | |
|---|---|---|---|
| 3,027,102 | 3/1962 | Lodige et al. | 241/98 |
| 3,251,389 | 5/1966 | Urschel et al. | 24/95 |
| 3,522,934 | 8/1970 | Walter | 241/98 |
| 3,823,880 | 7/1974 | Urschel | 241/95 |
| 3,974,969 | 8/1971 | Herbst, Sr. | 241/98 |
| 4,235,382 | 11/1980 | Smith | 241/86 |
| 4,610,397 | 9/1986 | Fischer et al. | 366/307 |

FOREIGN PATENT DOCUMENTS

| | | | |
|---|---|---|---|
| 0049450 | 4/1982 | European Pat. Off. | 366/302 |

*Primary Examiner*—Harvey C. Hornsby
*Assistant Examiner*—Joseph S. Machuga
*Attorney, Agent, or Firm*—Browdy & Neimark

[57] ABSTRACT

A pinned mill for a mixer having a mixing mechanism has a motor outside the mixer container and a rotor inside the container and spaced apart from its walls. The rotor is rotationally drivable by the motor and is at least partly surrounded at a tangent by a stator having pins arranged concentrically with the rotor axis, the rotor being arranged inside the pins. The rotor is provided with elements defining a grinding gap with respect to the pins. In order to improved the grind performance without notably increasing the drive power, the rotor elements defining the grinding gap with respect to the stator pins are embodied only by vanes extending approximately radially to the rotor axis. The radially outer ends of the vanes have a cutting edge. The stator pins have an edge associated with the radially outer vane edges. The rotor is also embodied as substantialy open, inside the stator.

8 Claims, 2 Drawing Sheets

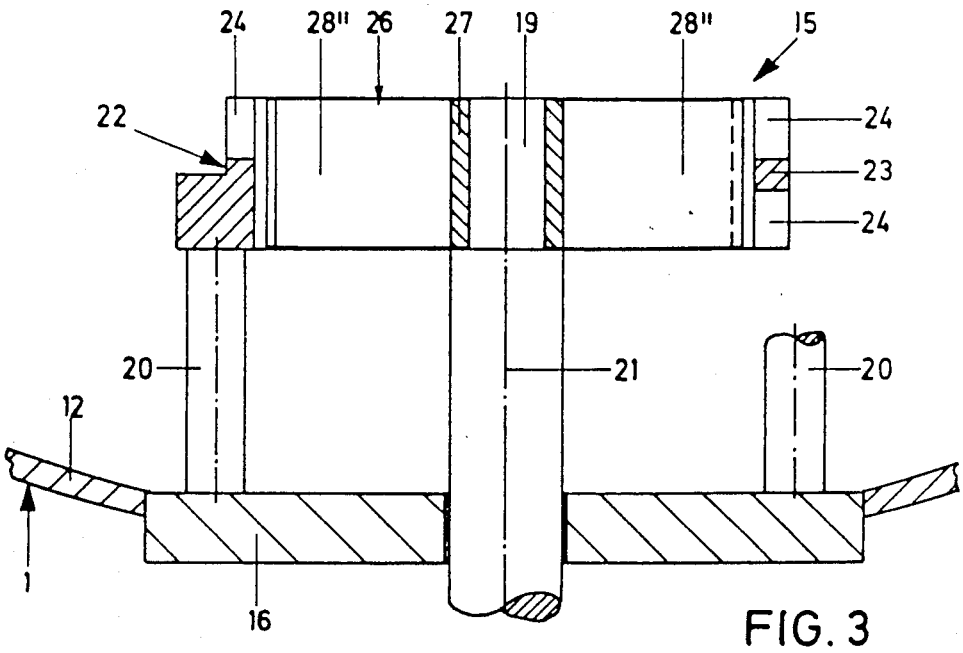
FIG. 3
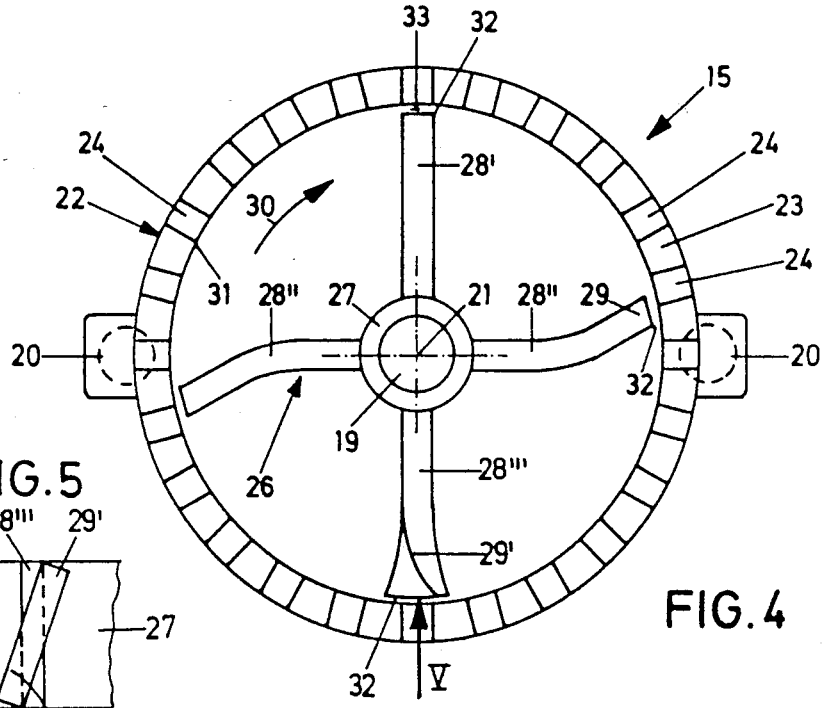
FIG. 4
FIG. 5
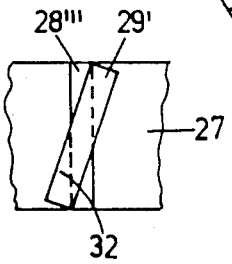

PINNED MILL FOR MIXERS

FIELD OF THE INVENTION

The present invention relates to a pinned mill for a mixer having a cylindrical container and a rotationally drivable mixing apparatus disposed in it. The mill has a motor outside the container, and inside the container it has a rotor spaced apart from the container wall and connected to the motor in a rotationally drivable manner; a stator at least partially surrounds the rotor at a tangent and has pins disposed approximately concentrically with the axis of the rotor. The rotor is disposed inside the pins and has elements that define a grinding gap with respect to the pins.

BACKGROUND OF THE INVENTION

Pinned mills for mixers of this kind have an annular stator, which is provided with cylindrical pins disposed parallel to one another. A disk-like rotor is arranged inside the stator, and cylindrical pins are arranged on the outer rotor circumference, parallel to the stator pins; a small gap is left between the pins so that the rotor pins travel past the stator pins. The rotor disk is driven at high speed by a motor located outside the mixer container. The rotor and stator are disposed spaced apart from the inside of the wall of the container. The mixing tools of the mixer may be embodied and arranged such that they slide at least partway through the space located between the rotor and stator, on the one hand, and the container wall on the other, so that the mixing tools will axially sweep through the greatest possible portion of the container. Accordingly, this provision is intended to prevent dead zones.

Pinned disk mills are used especially to distribute viscous, or pourable, materials in a defined manner, because a shear gradient is generated in the gap between the rotor pins and the stator pins.

The grinding effect in these pinned disk mills is not satisfactory, however. To improve the grinding performance, attempts have already been made to provide holes in the rotor disk. This merely increases the drive power of the pinned disk mill, without improving the grinding performance.

SUMMARY OF THE INVENTION

It is accordingly the object of the present invention to develop a pinned mill of the above type such that the grinding performance is improved, without notably increasing the drive power.

This object is attained in accordance with the invention as described below. Unexpectedly, it has been found that by omitting the rotor disk with its rotor pins, and replacing it with vanes, i.e., a propeller, a considerable improvement in the grinding performance of pinned mills is attained in terms of the overall process in the mixer. This can be explained by the fact that the vanes exert a very much greater radial and tangential pushing action on the individual particles; that is, considerably larger quantities of mixing or grinding stock particles per unit of time are fed through the grinding gap between the outer ends of the vanes and the stator pins, where they are subjected to a high shear gradient. Overall, during the mixing process, with a batch-operated mixer, the individual particles therefore enter the grinding gap much more frequently. Although in the embodiment according to the invention the mixing tools largely sweep the space between the rotor and the stator, on the one hand, and the inner wall of the container on the other - which is conventional per se - here again a feeding of the mixing or grinding stock to the pinned mill takes place. In this sense, this inherently known sweep through this space leads to a completely different effect, specifically to an improved grinding performance on the part of the pinned mill. When cutting edges on the ends of the vanes are paired with edges of the stator pins the shear phenomena in the grinding gap are improved considerably.

As also explained below, the embodiment according to the invention makes it possible to obtain particularly optimized feeding effects.

Further advantages and features of the invention will become apparent from the ensuing description of an exemplary embodiment, taken in conjunction with the drawings.

BRIEF DESCRIPTION OF THE DRAWINGS

FIG. 3 is a fragmentary section taken through FIG. 1 along the line III—III;

FIG. 4 is a plan view on the pinned mill; and

FIG. 5 is a front view according to the arrow V of FIG. 4.

DESCRIPTION OF THE PREFERRED EMBODIMENT

Figure 1:
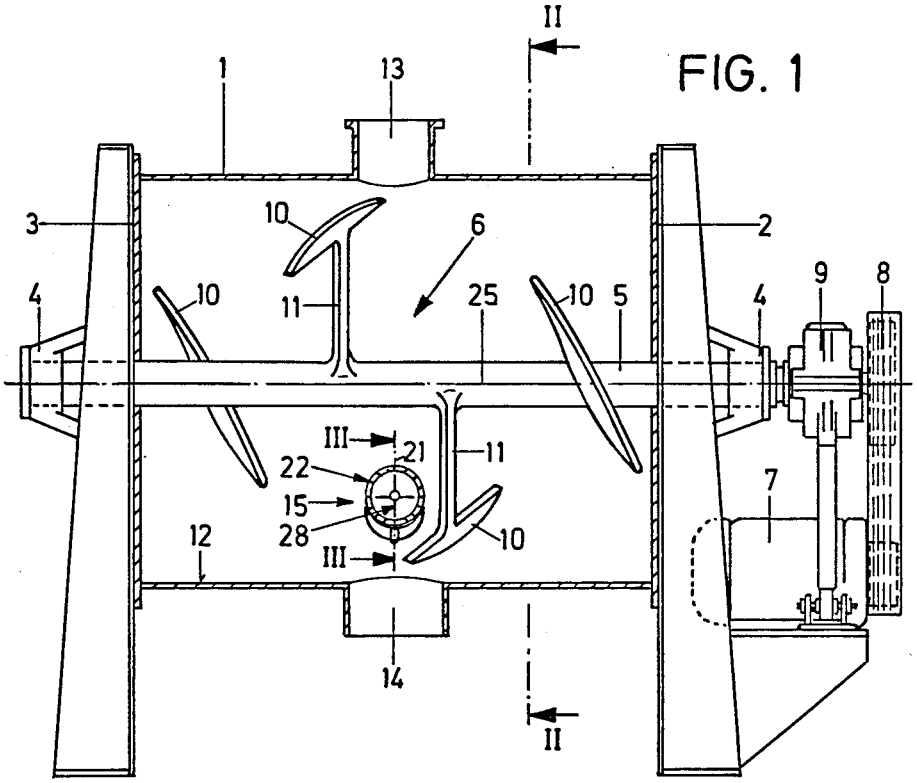
FIG. 1 is a vertical longitudinal section taken through a mixer.

The largely conventional mixer shown in the drawing has a horizontal, stationary, cylindrical container 1, which is closed off at the ends and at the same time held in place by side walls 2, 3 acting at the same time as a stand. Bearing blocks 4 are secured to the side walls 2, 3, and a shaft 5 of a mixing mechanism 6 is supported in the bearing blocks 4 concentrically with the container 1. The shaft 5 is driven by a drive motor 7 via a V-belt drive 8 and a transmission 9. The mixing mechanism 6 has paddle-like mixing tools 10, which are retained by means of mixing tool carriers 11 attached to and radially protruding from the shaft 5. The mixing tools 10 themselves are located in the vicinity of the inner wall 12 of the container 1.

An inlet 13 for stock to be mixed is located on top of the container 1, while an outlet 14 for the stock is provided on the bottom. The mixer is operated in batches, as a so-called turbulent mixer; that is, it is a throwing type of mixer, in which the individual particles of mixing stock are thrown upward and then travel on a parabolic trajectory back to a bed of mixing stock. To attain this effect, the mixing tools 10 are driven at supercritical circumferential speed, which can be expressed, using the dimensionless Froude number, as approximately Fr=2–6.

The Froude number is defined as $$Fr = W^2 : R \times g$$

where

W = circumferential speed of the radially outer ends of the mixing tools 10, in meters per second (m/s);

R = radius of the mixing mechanism 6, in meters (m); and g = acceleration due to gravity, in meters per second squared ($m/s^2$).

Figure 2:
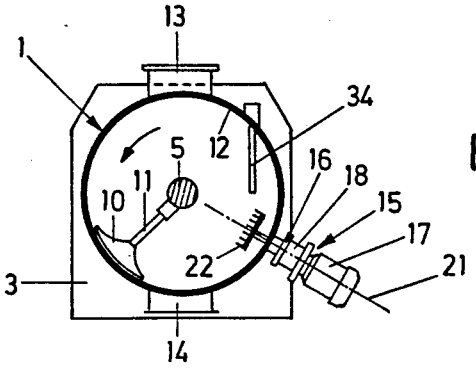
FIG. 2 is a cross section taken through the mixer along the line II—II of FIG. 1, on a smaller scale.

A pinned mill 15 is built into the wall 12 of the container 1 and will now be explained in detail. A flanged bearing 16, to which a motor 17 is flanged, is attached to the outside of the wall 12 of the container 1, specifically in the area below the shaft 5 (see FIG. 2). A coupling 18 connects the drive shaft of the motor 17 with a drive shaft 19 of the pinned mill 15. The drive shaft 19 extends through the wall 12. The pinned mill 15 also has two support rods 20, serving as stator supports, which also extend through the wall 12 and are arranged in a radial plane to the shaft 5, so that they present only a slight hindrance to the mixing tools 10, as it particularly clearly shown in FIG. 1. A stator 22, comprising a ring 23 and pins 24, is attached to the two support rods 20 concentrically with the axis 21 of the drive shaft 19. The pins 24 extend parallel to the axis 21 and are arranged on a circular ring. The axis 21 also intersects the axis 25 of the shaft 5 at a right angle, as shown in FIG. 2. The width of the ring 23 is only just large enough to enable securing it to the support rods 20 and to enable meeting other structural requirements.

A rotor 26, joined in a rotationally fixed manner to the drive shaft 19, is arranged radially inside the pins 24 and embodied like a propeller. To this end, it has a hub 27 joined in a rotationally fixed manner to the drive shaft 19, and vanes 28 extending approximately radially outward are attached to the hub 27. These vanes 28 may be variously embodied. In the simplest version, a vane 28' is embodied as a simple elongated, rectangular profile bar, which is disposed radially with respect to the axis 21 and exerts purely tangential forces upon the individual particles of mixing stock. A vane 28'' may be embodied such that its radially outer end 29 is trailing, with respect to the direction of rotation 30 of the drive shaft 19, and so exerts a combined radial and tangential acceleration on the mixing stock. Finally, in a vane 28''', at least the outer end 29' can also be positioned obliquely, so that it moves past the pins 24 like a drawn cut, as shown in FIG. 5.

The pins 24 have a square cross section, in the exemplary embodiment shown. The actual-cross sectional shape is unimportant; however, the edge 31 of each pin 24 does have some importance, being associated with a corresponding cutting edge 32 on the radially outer end 29 or 29' of the vanes 28. Between a given edge 31 and the corresponding cutting edge 32, a certain cutting effect thus takes place—that is, when there is a gap 33, 1 to 3 mm in width, between the cutting edge 32 and the edge 31.

The rotor 26 of the pinned mill 15 is driven at a rotational speed of 1500 to 3000 rpm.

During typical operation, the container 1 is filled to approximately 50% to 70% of its volume with mixing stock. The stock is turbulently mixed by the mixing mechanism, being generally shaken loose and thrown about through the mixing container. The vanes 28 of the rotor 26 drive individual particles of mixing stock at high speed through the pins 24 of the stator 22. The mixing stock travels to the vanes 28 not only from the interior of the container 1 but also, by means of the mixing tools 10, from the area between the wall 12 of the container 1 and the stator 22. This happens especially because the mixing tools 10 virtually completely sweep the region between the stator/rotor on the one hand and the wall 12 on the other. The only space that is not swept is the space covered by the two support rods 20 and the drive shaft 19. These three parts are after all located in the same plane, radial to the axis 25 of the shaft 5. This way of delivering the stock to the rotor 26 is particularly efficient, because the space between the ring 23 of the stator 22 is completely open, and all that is located in it is the rotor 26 with its vanes 28.

The use of the pinned mill 15 is particularly important whenever a powdered or pourable material is to be mixed in the mixer with relatively small amounts of liquid, or in other words where the liquid is merely intended to moisten the individual particles of mixing stock. In such cases, clumps largely tend to form, which must then be broken up again. The liquid can be furnished directly into the vicinity of the pinned mill, for instance by means of a nozzle 34 for liquid. Such uses and applications are well known for pinned mills.

The foregoing description of the specific embodiment(s) will so fully reveal the general nature of the invention that others can, by applying current knowledge, readily modify and/or adapt for various applications such specific embodient(s) without departing from the generic concept, and, therefore, such adaptations and modifications should and are intended to be comprehended within the meaning and range of equivalents of the disclosed embodiment(s). It is to be understood that the phraseology or terminology employed herein is for the purpose of description and not of limitation.

What is claimed is:

1. A pinned disk mill for a mixer having a container with a cylindrical wall and a mixing apparatus disposed therein, said mixing apparatus being driven to rotate by a driving means and comprising a mixer shaft having mixing tools extending therefrom, said mill comprising:

a motor disposed outside the container;

a rotor disposed inside the container, spaced apart from said cylindrical wall, and connected to said motor in a rotationally drivable manner about an axis;

a stator having open upper and lower ends at least partially surrounding said rotor at a tangent and having pins disposed approximately concentrically about said axis of said rotor, said rotor being disposed inside the pins;

said rotor having elements defining a grinding gap with respect to the pins of said stator, said elements comprising vanes extending approximately radially outwardly from the rotor axis and having radially outer ends comprising a cutting edge, and wherein the pins of the stator each have at least one edge associated with the radially outer ends of the vanes and said rotor inside said stator is substantially open whereby material within said container can flow axially through said mill.

2. A pinned mill as defined in claim 1 wherein mixing tools of the mixer are at least partly movable through a space located between said wall of the container and the rotor and stator.

3. A pinned mill as defined in claim 2, wherein the vanes are approximately flat and are disposed in a plane receiving the axis of the rotor and extend substantially at right angles to the axis of the rotor.

4. A pinned mill as defined by claim 2, wherein the radially outer ends of the vanes trail with respect to the rotational direction of the rotor.

5. A pinned mill as defined by claim 2, wherein the radially outer ends of the vanes are inclined with respect to a plane receiving the axis of the rotor.

6. A pinned mill as defined in claim 1, wherein the vanes are approximately flat and are disposed in a plane receiving the axis of the rotor and extend substantially at right angles to the axis of the rotor.

7. A pinned mill as defined by claim 1, wherein the radially outer ends of the vanes trail with respect to the rotational direction of the rotor.

8. A pinned mill as defined by claim 1, wherein the radially outer ends of the vanes are inclined with respect to a plane receiving the axis of the rotor.

* * * * *